United States Patent [19]

Bertram et al.

[11] Patent Number: 4,587,903

[45] Date of Patent: May 13, 1986

[54] TRIPPING SYSTEM FOR ELECTRICAL PERCUSSION FUSES

[75] Inventors: Friedrich Bertram, Schwaig; Uwe Brede, Fürth; Gerhard Kordel, Nürnberg-Kornburg, all of Fed. Rep. of Germany

[73] Assignee: Dynamit Nobel Aktiengesellschaft, Troisdorf, Fed. Rep. of Germany

[21] Appl. No.: 559,092

[22] Filed: Dec. 7, 1983

[30] Foreign Application Priority Data

Dec. 8, 1982 [DE] Fed. Rep. of Germany ..... 3245375

[51] Int. Cl.[4] ..... F42C 1/04; F42C 19/06; H01H 35/40

[52] U.S. Cl. ..... 102/216; 102/263; 102/273; 200/83 A; 200/83 Y

[58] Field of Search ..... 102/216, 262, 263, 273; 200/61.45 R, 83 A, 83 N, 83 Y

[56] References Cited

U.S. PATENT DOCUMENTS

| | | | |
|---|---|---|---|
| 2,887,056 | 5/1959 | Perret | 102/216 |
| 3,009,031 | 11/1961 | Friend et al. | 200/83 N |
| 3,158,705 | 11/1964 | Bliss | 102/216 |
| 3,372,642 | 3/1968 | Brothers | 102/216 |
| 3,450,046 | 6/1969 | Cooke et al. | 102/216 |
| 3,788,225 | 1/1974 | Held | 102/216 |

*Primary Examiner*—Charles T. Jordan
*Assistant Examiner*—Ted L. Parr
*Attorney, Agent, or Firm*—Antonelli, Terry & Wands

[57] ABSTRACT

An ignition system for projectiles, such as shells, bombs, or rockets is disclosed. The system has a pressure chamber defined by a double-diaphragm switch and a cap of a deformable material. The diaphragm of the double-diaphragm switch, which defines one wall of the pressure chamber, contains one or several perforations, the number and diameter of which depend on the spacing of the diaphragms, the areas thereof and the size of the pressure chamber. The double-diaphragm switch is connected to an electric ignition unit. An electrical circuit is closed only if a projectile housing a percussion fuse and the ignition system impacts on the ground or target after its flight. Any unintended ignition during firing or due to brief impact stress cannot occur.

6 Claims, 3 Drawing Figures

TRIPPING SYSTEM FOR ELECTRICAL PERCUSSION FUSES

The present invention relates to a tripping system or arrangement for electrical percussion fuses wherein a circuit is closed at the instant of impact. This circuit leads, in a manner known, per se, to a primer pellet or some other suitable electric primer means which is ignited by the occurring current flow.

It is known to use electrical or mechanical tripping systems in electrical detonator means as utilized, for example, in projectiles such as shells, rockets, or bombs, in order to trigger detonation upon impact on a target. Mechanical switches exhibit the disadvantage that they must initially be locked during firing and at the concomitant, high accelerations. Such locking action must be very reliable to prevent unintended premature detonation. Therefore, such switches are usually very expensive.

A simple mechanical tripping system is described, for example, in German Pat. No. 1,145,522. In this reference, a double-walled cap of a conductive material is arranged above the ignition system, the walls of this cap being mutually insulated. At the instant of impact, the two walls come in contact with each other and close a circuit which causes ignition of a primer pellet. Such a triggering of detonation, however, has the grave disadvantage that it can easily occur unintentionally, for example, when the detonator is deformed by dropping or some other accidental exertion of pressure. This drawback is overcome in the detonator means of German Pat. No. 1,145,522 by the feature that the mechanical tripping device described therein is linked with a piezoelectric switch, which switch places the primer pellet into the position correct for ignition only after the exertion of a pressure as built up perforce, for example, during the firing of projectiles, and after a subsequent pressure drop. Such a detonating system is expensive and requires a relatively large amount of space.

Therefore, an object of this invention is to provide a tripping system for electrical percussion fuses insensitive to unintentional deformation, which system performs perfectly upon impact, independently of additional switching systems, and occupies a small volume.

In attainment of this object, a tripping system for electrical percussion fuses has now been developed wherein, at the instant of impact, an electric circuit is closed, characterized in that the system comprises a volume-variable pressure chamber which is partially or entirely enclosed by a cap of a deformable material and by a double-diaphragm switch wherein the diaphragm delimiting the pressure chamber exhibits one or several perforations.

In such a tripping system, at the instant of impact, the pressure in the pressure chamber is higher than in the interspace or space between the two diaphragms, so that the diaphragms can come in contact with each other, thus, closing a circuit leading, for example, to an electric primer pellet. On the other hand, with a pressure buildup in the pressure chamber which is relatively gradual as compared with the above, as occurs, for example, during the firing phase of the projectile, the arrangement ensures that there is not such a great pressure difference between pressure chamber and interspace of the diaphragms, so that the diaphragms cannot come in contact with each other and do not trigger an unintended ignition current. Thus, according to this invention, contacting of the two diaphragms of the double-diaphragm switch takes place only if, within a short period of time, a high pressure is built up in the pressure chamber, greater than the pressure in the interspace between the two diaphragms of the double-diaphragm switch. Such high pressures, building up within a brief time span, arise, for all practical purposes, only after a flight of the above-described triggering system in a projectile which impacts on solid ground or a like target surface.

The material of the cap defining the pressure chamber at least toward one side is to be deformable so that, upon impact, a pressure wave can be built up, or the volume of the pressure chamber can be briefly deformed or compressed. Especially suited for this purpose are, for example, elastomers, natural rubber, synthetic rubbers or silicone rubber. However, a relatively stiff material, such as, for example, metallic foil, is likewise suitable, provided this material will be deformed during impact without being destroyed. The cap is firmly seated on the double-diaphragm switch or on its mounting elements.

The double-diaphragm switch, which is positioned at an end portion of the cap and which, in part, defines the pressure chamber, alone is known, per se. Its mode of operation is, in principle, the same as in other fields of use for such double-diaphragm switches; upon contact between the two diaphragms, a circuit is closed which, in the present instance, leads to an electrically trippable or actuable ignition source, preferably, a primer pellet via an electrical power source, for example an electrochemical cell.

The diaphragms of the double-diaphragm switch must, of course, consist of an electrically conductive material such as a thin metal foil, out of copper-beryllium bronze, with a thickness of the foil of about 0.02 to 0.05 millimeter (mm), or the like, and must be arranged at such a spacing from each other that they can touch when exposed to pressure. Typical spacings between the diaphragms are about one millimeter (mm). The diaphragm facing the pressure chamber contains one or several perforations, the number and diameter of which are dependent, inter alia, on the volume of the pressure chamber and on the spacing of the two diaphragms, which are arranged substantially in parallel to each other. Typical diameters for the one or several perforations are in the range between about 0.5 to 2 millimeter (mm).

The two diaphragms should, if possible, have the same mass. This ensures a uniform flexing with the spacing remaining constant when acceleration forces are effective on the diaphragms as they occur during firing of projectiles. With the same material and the same surface area of the two diaphragms, both diaphragms also exhibit identical vibration characteristics so that touching of the two diaphragms is impossible even under short-term impact stress, causing vibrating of the diaphragms. A contact between the diaphragms—and, thus, a switching effect—is only attained if one diaphragm is acted upon with a force different than the other; this is the case, for example, if temporally rapid pressure changes act on the diaphragms, so that the pressure in the pressure chamber is higher than in the interspace between the two diaphragms.

The invention is shown by way of one embodiment in the accompanying drawings wherein.

Numerals 1 and 2 denote the two diaphragms, the interspace 7 being provided between them. A pressure chamber 4 is furthermore defined by the cap 3 which is made of a silicone rubber. Other suitable materials include natural rubber or other synthetic rubbers. The cap 3 is secured to the projectile by snap or clamps connection, by adhesive connection or, in case a cap of metallic material is used, connection can also be made by welding, riveting and the like. The pressure Pi in the chamber is equal to the pressure Pii in the interspace 7 due to the perforations in diaphragm 1.

Figure 1:
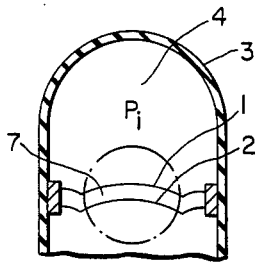
FIG. 1 shows a cross-section through a complete percussion switch.
Figure 2:
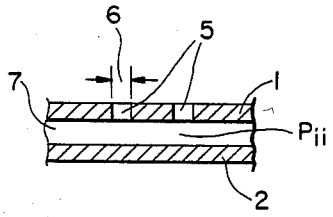
FIG. 2 is an enlarged cross-sectional view of the encircled area of FIG. 1.

The two diaphragms 1 and 2 are illustrated in FIG. 2 on an enlarged scale. Perforations 5 are arranged in the diaphragm 1. These perforations permit fluid pressure compensation between the pressure chamber 4 and the interspace 7 in case of gradual pressure buildup in the pressure chamber 4. With temporally rapid pressure changes in pressure chamber 4, as they can occur only upon impact from full flight when the switch forms an impact end of a projectile, these compensating bores have no effect; that is, the bores or perforations serve to prevent or block a rapid pressure change and the diaphragms are caused to contact each other by the resultant sudden increase in pressure and the movement of the diaphragms.

Figure 3:
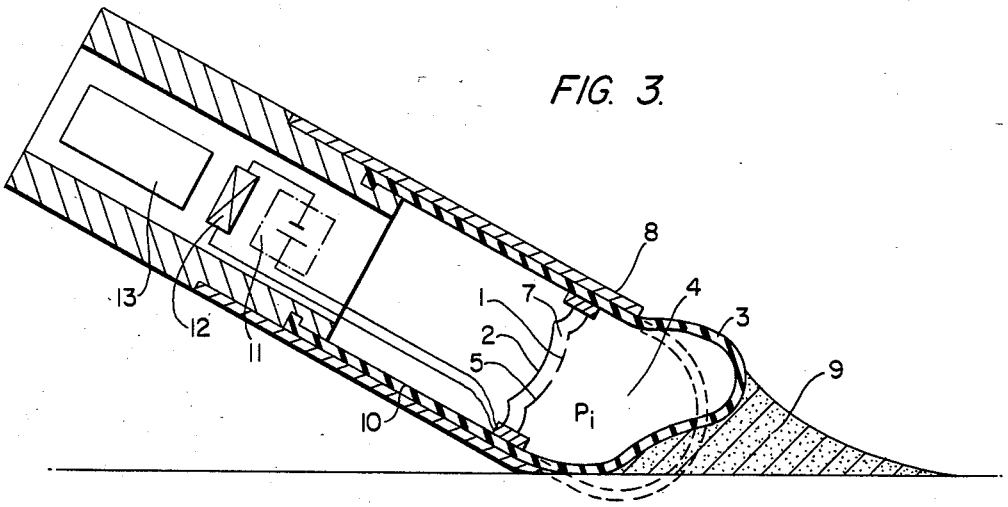
FIG. 3 shows a cross-sectional view through the switch at one end of a projectile upon impact and shows the complete electrical circuit comprising the switch, connecting wires, electric primer pellet and electrical power-source.

A specific embodiment of the invention with a projectile is illustrated in FIG. 3. In this embodiment, a reinforcing casing 8 is arranged around the tripping system in the area of the double-diaphragm switch. This enclosure can have the form of a sleeve or of a ring surrounding the pressure chamber 4 at least in the portion defined by the diaphragm switch made up of diaphragms 1 and 2. This enclosure can also extend beyond the diaphragm switch; however, it must still leave a portion of the cap 3 uncovered.

The material of this reinforcing enclosure is to be firm and rigid. Suitable materials are metals or alloys, as well as hard synthetic resins which may form a sleeve around the connection between the projectile body and one portion of the cap or may also form a part of the projectile body. It will be understood that the switch is connected electrically via a wire 10, for example and an electrical power source 11, to an electrical primer pellet 12 which may be located further in the body of the projectile. Electric primer pellet 12 is located close to booster charge 13. The reinforcing enclosure, when the detonator hits targets of soft material 9 within a very small impact angle, effects a scraping away of this material 9 upon impact. The soft ground material, such as for example, water, sand, or snow, is thereby dug up, so to speak, whereby the resistance with respect to the cap is increased; as a consequence, the cap is deformed more advantageously and more rapidly, and exerts the desired pressure on the diaphragm of the double-diaphragm switch facing the pressure chamber; i.e., pressure $P_i$ become greater than the pressure $P_{ii}$ in the interspace when the front end of the projectile impacts the soft ground material.

We claim:

1. A tripping system for actuating a percussion fuse wherein an electric circuit is closed at the instant of impact of the system, which comprises a volume-variable pressure chamber partially or entirely enclosed by a cap of a deformable material and by a double-diaphragm electrical switch, one diaphragm of said switch which defines the pressure chamber exhibiting at least one perforation for allowing gradual equalization of pressure within the chamber and an interspace between diaphragms of said double-diaphragm electrical switch.

2. A tripping system for a percussion fuse according to claim 1, wherein the diaphragms of the double-diaphragm switch each have an identical mass.

3. A tripping system for a percussion fuse according to claim 1, wherein the cap consists of a silicone rubber.

4. A tripping system for a percussion fuse according to claim 2, wherein the cap consists of a silicone rubber.

5. A tripping system for a percussion fuse according to claim 1, wherein a reinforcing enclosure is arranged around one portion of the cap in a region surrounding the double-diaphragm switch.

6. A tripping system according to claim 1, wherein said system is positioned at an impact end of a projectile body containing an ignition unit electrically connected to said switch.

* * * * *